US005887440A

United States Patent [19]

Dubé

[11] Patent Number: 5,887,440

[45] Date of Patent: Mar. 30, 1999

[54] REFRIGERATION COIL DEFROST SYSTEM

[76] Inventor: Serge Dubé, 2595 Bourgogne, St. Lazare, Quebec, Canada, J0P 1V0

[21] Appl. No.: 926,794

[22] Filed: Sep. 10, 1997

[30] Foreign Application Priority Data

Sep. 13, 1996 [JP] Japan ..... 8-24388

[51] Int. Cl.[6] ..... F25D 21/12

[52] U.S. Cl. ..... 62/82; 62/282

[58] Field of Search ..... 62/82, 282, 80, 62/275, 276

[56] References Cited

U.S. PATENT DOCUMENTS

| | | | |
|---|---|---|---|
| 2,081,479 | 5/1937 | Fink | 62/82 |
| 2,748,574 | 6/1956 | Gaston | 62/282 |
| 2,902,835 | 9/1959 | Boyle et al. | 62/282 |
| 4,172,493 | 10/1979 | Jacobs | 62/82 |
| 4,188,794 | 2/1980 | Skala | 62/282 |
| 4,308,042 | 12/1981 | Ecker | 62/282 |
| 4,336,692 | 6/1982 | Ecker et al. | 62/282 |
| 5,249,433 | 10/1993 | Hardison et al. | 62/282 |

*Primary Examiner*—William E. Tapolcai
*Attorney, Agent, or Firm*—Carter & Schnedler, P.A.

[57] ABSTRACT

A defrost system 10 for a refrigerated display counter 11 is described. The system 10 comprises a defrost conduit 14 which is adapted to be positioned in close proximity to a refrigeration coil 12 of a refrigerated display counter 11. A heat exchanger 13 has a housing 16 which is adapted to be secured above the refrigerated display counter. The housing is provided with a plurality of fans 18 for directing ambient air into the housing and out through exhaust port 20. A heat exchange coil 22 is provided in the housing 16 and is interconnected with the defrost conduit 14 and through which flows a liquid such as glycol. A pump 28 circulates the defrost liquid through the circuit 24–25 and control valves 26–27 are provided to arrest the liquid flow in a non-defrost mode. In the defrost mode the glycol is heated by the ambient air which is convected through the heat exchange housing 16 and the cool air 9 generated at the outlet ducts 20 is mixed with hotter ambient air. The system is energy efficient.

12 Claims, 2 Drawing Sheets

REFRIGERATION COIL DEFROST SYSTEM

TECHNICAL FIELD

The present invention relates to a defrost system and particularly for defrosting the refrigeration coil of a refrigerated display counter.

BACKGROUND ART

The prior art, as exemplified for example by U.S. Pat. Nos. 5,263,892, 5,249,433, 4,283,922, 4,285,204, 4,336,692, 4,188,794, 4,4944,158, 4,208,884, 4,304,098, U.K. Patent 2,133,129 and Japanese Patent 54-34170, teaches that known defrost systems are complex in design, utilize electric heating elements systems which are energy consuming and costly, utilizes heat air convection systems inside the refrigerated display counter, they often require maintenance and are not very energy efficient. Furthermore, these systems are dedicated to defrost a single refrigerating coil and therefore there is a need to adapt a system to each refrigerated display counter utilizing a refrigerating coil. This is also very expensive and energy inefficient.

SUMMARY OF INVENTION

It is a feature of the present invention to provide a defrost system for a refrigerated display counter and which substantially overcomes the above-mentioned disadvantages of the prior art.

Another feature of the present invention is to provide a defrost system for a refrigerated display counter and wherein a defrost liquid is pumped through an ambient air heat exchanger to heat the liquid and simultaneously defrost a refrigeration coil and wherein the cool air extracted from the defrost liquid is released in admixture with hotter ambient air whereby to cool the air and provide an energy saving.

Another feature of the present invention is to provide a defrost system for defrosting a refrigerating coil of a refrigerated display counter and which system utilizes a heat exchanger which uses ambient air to heat the defrost liquid and wherein the heat exchanger may be adapted to a plurality of refrigerated display counters.

Another feature of the present invention is to provide a defrost system for defrosting a refrigeration coil of a refrigerated display counter and which system is easy to install, requires very little maintenance, is inexpensive and energy efficient.

According to a further broad aspect of the present invention there is provided a method of defrosting a refrigerated display counter having a refrigeration coil and which method substantially overcomes the above-mentioned disadvantages of the prior art.

According to the above features, from a broad aspect, the present invention provides a defrost system for a refrigerated display counter. The system comprises a defrost conduit adapted to be positioned in close proximity to a refrigeration coil of the refrigerated display counter. A heat exchanger having a heat exchange housing is adapted to be secured in proximity to the refrigerated display counter. A plurality of fans is secured to the housing for directing ambient air into the housing and out through exhaust ports. A heat exchange coil is provided in the housing. Conduit means interconnect opposed ends of the heat exchange coil to opposed ends of the defrost conduit to constitute a defrost circuit. A defrost liquid is provided in the defrost circuit. A pump is connected to the circuit to circulate the defrost liquid through the defrost circuit. Control valve means are provided to arrest the defrost liquid in the defrost conduit during a non-defrost mode of the system. The system when in a defrost mode circulates the defrost liquid through the heat exchange coil in the heat exchange housing where ambient air convected by the fans warms the defrost liquid to defrost the refrigeration coil. The exhaust ports release cooled air above the refrigerated display counter for admixture with warmer ambient air.

According to a further broad aspect of the present invention there is provided a method of defrosting a refrigerated display counter having a refrigeration coil. The method comprises the steps of disposing a defrost conduit of a defrost circuit in close proximity to the refrigeration coil. The defrost circuit has a heat exchange coil located in a heat exchange housing secured above the refrigerated counter. The housing has a plurality of fans for directing ambient air into the housing and out through exhaust ports. A defrost liquid is circulated through the defrost circuit by a pump during the defrost mode of the system. The defrost liquid is heated by the ambient air as it is convected through the heat exchange coil. Cool air from the heat exchanger is exhausted through the exhaust ports of the heat exchange housing for admixture with warmer ambient air. The cooling coil is defrosted by the warm defrost liquid.

BRIEF DESCRIPTION OF DRAWINGS

A preferred embodiment of the present invention will now be described with reference to the accompanying drawings in which.

DESCRIPTION OF PREFERRED EMBODIMENTS

Figure 1:
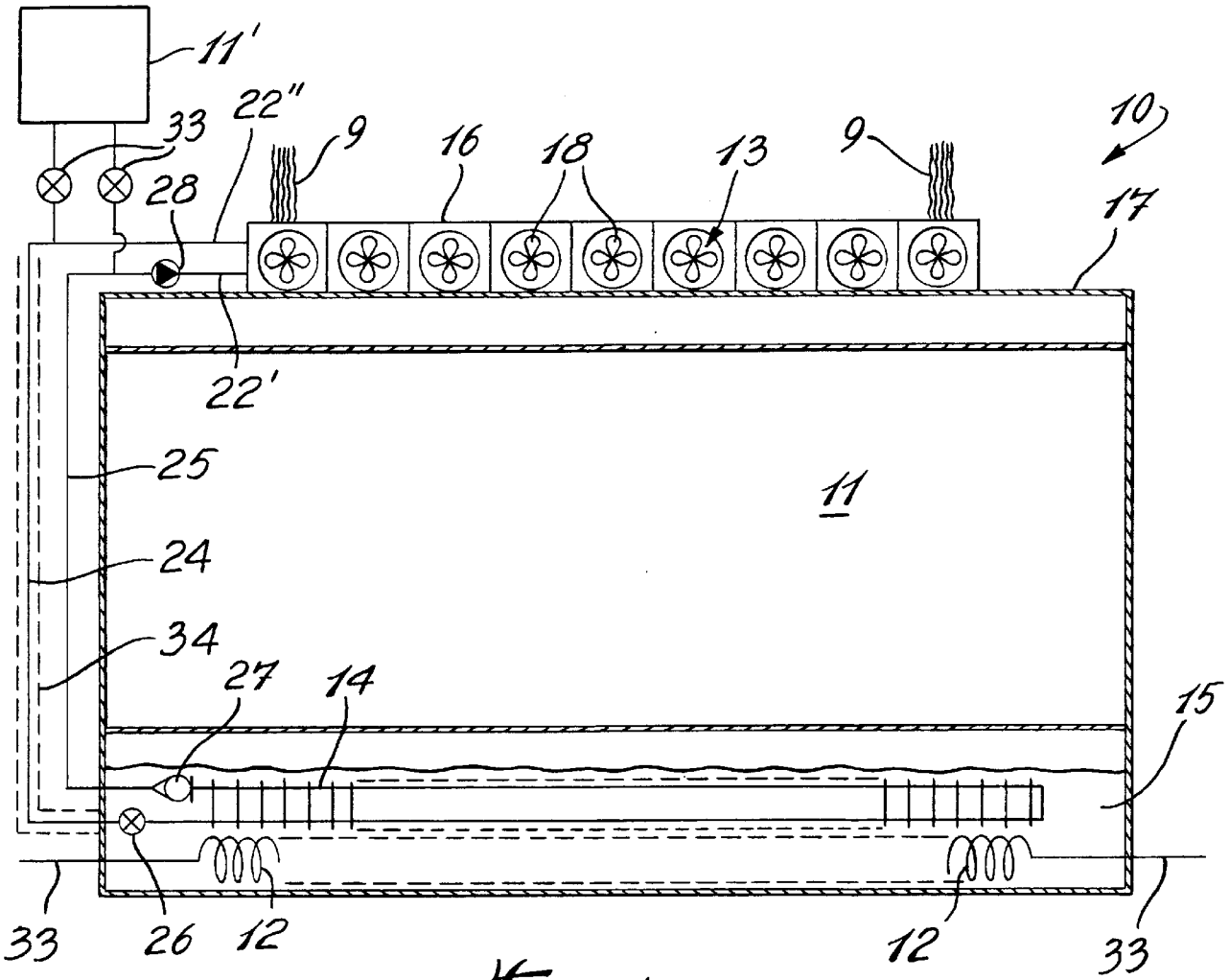
FIG. 1 is a schematic diagram of the defrost system of the present invention incorporated with a display refrigerated counter.

Referring now to the drawings and more particularly to FIG. 1, there is shown generally at 10 the defrost system of the present invention which is adapted to a refrigerated display counter 11 herein schematically illustrated. The refrigerated display counter 11 is provided with a refrigeration coil 12 to cool the refrigeration counter and the foodstuff (not shown) usually displayed therein. Essentially, the defrost system of the present invention consists of a heat exchanger 13 and a defrost coil or conduit 14 which is secured in close proximity to the refrigeration coil 12 whereby to defrost the coil 12 and melt ice 15 that is usually formed thereabout. Although not shown, a drip pan is usually secured in close proximity to the refrigerating coil whereby to collect any evacuated water during the defrost cycle. The defrost coil or conduit 14 is formed to adapt to the cooling coil 11 and the area thereabout, although it is herein illustrated as a single loop coil.

Figure 2:
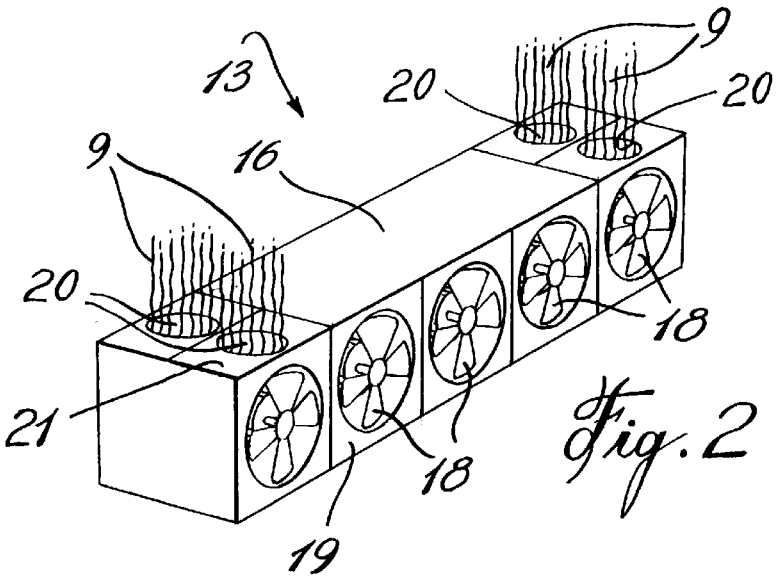
FIG. 2 is a perspective view showing the construction of the heat exchanger.
Figure 3:
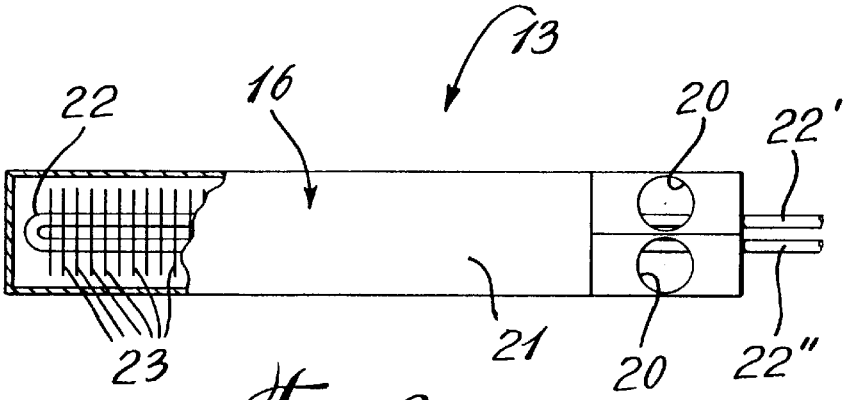
FIG. 3 is a top view of the heat exchanger of FIG. 1 partly fragmented showing the heat exchange coil therein.

Referring now additionally to FIGS. 2 and 3, it can be seen that the heat exchanger 13 has a heat exchange housing 16 which is adapted to be secured in proximity to the refrigerated counter 11 and as herein shown secured to a top wall 17 of the refrigerated display counter. The reason for this is two-fold. Firstly, there is more hot air at the upper level of the refrigerated counter to be drawn into the heat exchange housing and secondly it is a convenient location to release cold air for admixture with the hot air whereby to reduce the air temperature and thereby produce a saving on the air conditioning needs of the supermarket in which refrigerated counters 11 are located.

As hereinshown, a plurality of turbines or fans 18 are secured to a sidewall 19 of the heat exchanger housing 16 and a plurality of exhaust ducts 20 are provided in the top wall 21 of the housing 16. A heat exchange coil 22, having a plurality of fins or plates 23 connected thereto, extends into the heat exchange housing 16 which is hereinshown as an elongated rectangular-like housing. The heat exchange coil 22 is formed as a loop and provided with an inlet 22' and an outlet 22".

The defrost conduit 17 is also provided with an inlet and an outlet conduit 25 and 24 respectively. These conduits interconnect to the inlet 22' and the outlet 22", respectively of the heat exchange coil 22 through valve means. The outlet conduit 25 may be provided with an insulating jacket 34 to reduce heat loss.

The valve means is constituted by a solenoid valve 26 connected to outlet conduit 24 and a check valve 27 connected to the inlet conduit 25. A pump 28 is connected to the inlet conduit 25 and circulates the defrost liquid, herein glycol, through the defrost circuit which is comprised of the heat exchange coil and the refrigerating coil interconnected in a loop. In the non-defrost mode, the solenoid valve 26 is inoperable whereby the glycol in the defrost conduit 14 is idle between the solenoid valve and the unidirectional check valve 27.

In the defrost mode the solenoid valve 26 is opened and the pump 28 is actuated whereby to circulate the glycol through the defrost circuit. The cooling coil circuit 33 is shut off. At the same time, the fans 18 are actuated whereby to convect hot ambient air, usually at a temperature of about 75° F. through the heat exchange housing 16 and out through the exhaust ducts 20 as a cooled air flow 9. Accordingly, the glycol is heated by the ambient air and as it is circulated past the defrost coil or conduit 14 will defrost the cooling coil 11 and melt any ice formation 15 thereabout. As the glycol is warmed by the ambient air convected by the fans 18, it cools the air which is convected through the heat exchange housing 16 and this cool air 9 is either exhausted directly upwardly to mix with the warmer air above the heat exchange housing 16 to lower the temperature of the air and thereby to provide an energy savings on the air conditioning system of the supermarket.

Figure 4:
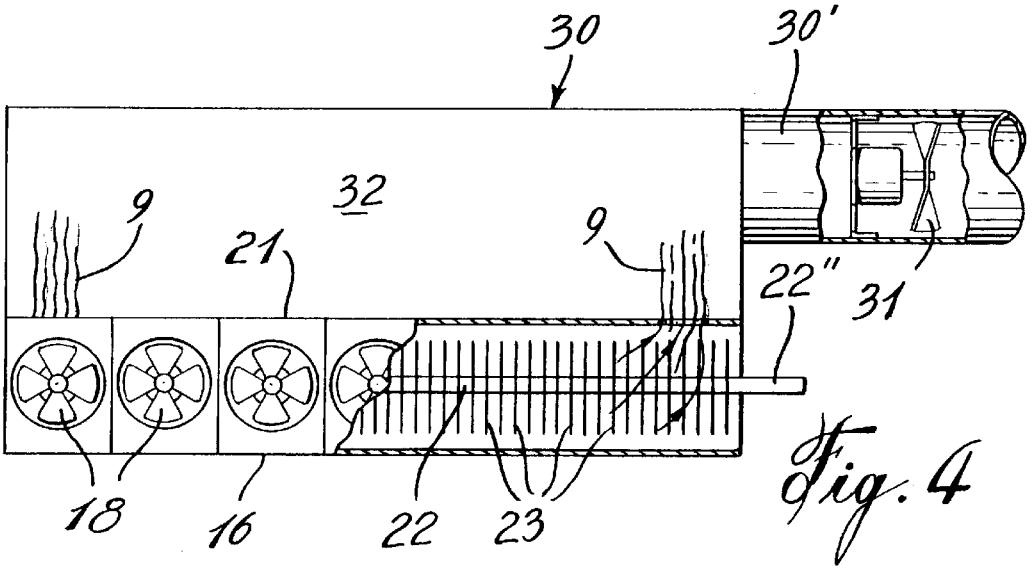
FIG. 4 is a fragmented side view showing a convection duct secured to the top wall of the heat exchanger housing for convecting the cooled air from the heat exchanger to a remote location.

As shown in FIG. 4, the cool air 9 released from the exhaust duct 20 in the top wall 21 of the heat exchange housing 16 may also be convected by a convection conduit system 30 to a remote location where the cool air 9 may be used more efficiently, if necessary. An impeller fan 31 draws the cool air from the collecting section 32 of the convection duct and draws it away from the housing 16. Dampers (not shown) may be provided at strategic locations along the duct 30'.

As is also shown in FIG. 1, the heat exchanger 13 may also be connected to two or more refrigerated display counters 11, 11', etc., through valves 33 which may be controlled from a remote location whereby a plurality of display counters may be defrosted independently and sequentially. The defrost cycle of a plurality of defrost counters, may be programmed so that each counter is defrosted one at a time and one after another. Accordingly, the defrost system of the present invention is inexpensive, very energy efficient, and may be automatically controlled.

Summarizing the method of operation of the defrost system of the present invention, it consists basically of disposing a defrost conduit of a defrost circuit in close proximity to a refrigeration coil of a refrigerated display counter. The defrost circuit has a heat exchange coil which is located in a heat exchange housing secured above the refrigerated housing. The housing has a plurality of turbines or fans therein for directing ambient air into the housing and out through exhaust ports. A defrost liquid is circulated through the defrost circuit by a pump during a defrost mode of the system. The defrost liquid is heated with the ambient air as it is convected through the heat exchange coil inside the heat exchange housing. The cooled air from the exhaust ports is exhausted for admixture with warmer ambient air. Simultaneously the cooling coil is defrosted by the warm defrost liquid. The cool air may also be convected from the exhaust ports to a remote location for cooling space or for other use. The heat exchange housing may also be connected to a plurality of refrigerated display counters through valve means so that a plurality of cooling coils can be defrosted sequentially.

It is within the ambit of the present invention to provide any obvious modifications of the preferred embodiments described herein, provided such modifications fall within the scope of the appended claims.

I claim:

1. A defrost system for a refrigerated display counter, said system comprising a defrost conduit adapted to be positioned in close proximity to a refrigeration coil of said refrigerated display counter, a heat exchanger having a heat exchange housing adapted to be secured in proximity to said refrigerated display counter, a plurality of fans secured to said housing for directing ambient air into said housing and out through exhaust ports, a heat exchange coil in said housing, conduit means interconnect opposed ends of said heat exchange coil to opposed ends of said defrost conduit to constitute a defrost circuit, a defrost liquid in said defrost circuit, a pump is connected to said circuit to circulate said defrost liquid through said defrost circuit, control valve means to arrest said defrost liquid in said defrost conduit during a non-defrost mode of said system, said system when in a defrost mode circulating said defrost liquid through said heat exchange coil in said heat exchange housing where said ambient air convected by said fans warm said defrost liquid to defrost said refrigeration coil, said exhaust ports releasing cooled air above said refrigerated display counter for admixture with warmer ambient air.

2. A defrost system as claimed in claim 1 wherein said heat exchange housing is an elongated housing secured above said refrigerated display counter, said exhaust ports being provided on a top wall of said elongated housing.

3. A defrost system as claimed in claim 2 wherein said fans are secured along a sidewall of said elongated housing.

4. A defrost system as claimed in claim 1 wherein said control valve means comprises a solenoid valve connected adjacent one end of said defrost conduit and a check valve connected adjacent another end of said defrost conduit whereby to arrest said defrost liquid therein during said non-defrost mode.

5. A defrost system as claimed in claim 1 wherein said defrost liquid is a glycol liquid capable of maintaining its liquid state during the refrigeration mode of said refrigeration coil.

6. A defrost system as claimed in claim 2 wherein an air convection duct is secured to said exhaust ports of said heat exchange housing for converting said cooled air to a remote location for cooling a space.

7. A defrost system as claimed in claim 1 wherein said control valve means comprises a pair of solenoid valves connected to an inlet and outlet of said heat exchange coil for connection to a defrost conduit of a further refrigerated display counter for defrosting a cooling coil associated therewith, said cooling coils of said refrigerated display counters being defrosted independent from one another, one at a time.

8. A method of defrosting a refrigerated display counter having a refrigeration coil, said method comprising the steps of:

i) disposing a defrost conduit of a defrost circuit in close proximity to said refrigeration coil, said defrost circuit having a heat exchange coil located in a heat exchange housing secured at a desired elevated location, said housing having a plurality of fans for directing ambient air into said housing and out through exhaust ports, ii) circulating a defrost liquid through said defrost circuit by a pump during a defrost mode of said system, iii) heating said defrost liquid with said ambient air as it is convected through said heat exchange coil in said housing, iv) exhausting cooled air from said exhaust ports for admixture with warmer ambient air, and v) defrosting said cooling coil with said warm defrost liquid.

9. A method as claimed in claim 8 wherein said step (iv) further provided the step of convecting said cooled air from said exhaust ports to one or more remote locations.

10. A method as claimed in claim 8 wherein there is further provided the step of arresting said defrost liquid in said defrost conduit during a non-defrost mode of said system.

11. A method as defined in claim 8 wherein there are two or more defrost circuits each associated with a respective one of two or more refrigerated display counters, said defrost circuits being connected to said heat exchange coil in said heat exchange housing by valve means, and wherein there is further provided the step of independently defrosting said refrigeration display counters one at a time.

12. A method as defined in claim 8 wherein said desired elevated location is a top portion of said refrigerated display counter.

* * * * *